US009024829B1

(12) United States Patent
Platt et al.

(10) Patent No.: US 9,024,829 B1
(45) Date of Patent: May 5, 2015

(54) HIDDEN CB ANTENNA ARRANGEMENT

(71) Applicant: R.A. Miller Industries, Inc., Grand Haven, MI (US)

(72) Inventors: John Jeremy Churchill Platt, Grand Haven, MI (US); Paul E. Miller, Spring Lake, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 231 days.

(21) Appl. No.: 13/735,369

(22) Filed: Jan. 7, 2013

Related U.S. Application Data

(60) Provisional application No. 61/584,908, filed on Jan. 10, 2012.

(51) Int. Cl.
*H01Q 1/32* (2006.01)

(52) U.S. Cl.
CPC ..... *H01Q 1/3208* (2013.01)

(58) Field of Classification Search
None
See application file for complete search history.

(56) References Cited

U.S. PATENT DOCUMENTS

| | | | | |
|---|---|---|---|---|
| 4,723,127 | A * | 2/1988 | Ohe et al. | 343/712 |
| 4,737,795 | A * | 4/1988 | Nagy et al. | 343/712 |
| 5,402,134 | A | 3/1995 | Miller et al. | |
| 6,906,672 | B1 | 6/2005 | Miller et al. | |
| 2007/0234500 | A1 * | 10/2007 | Holmes | 15/250.3 |

* cited by examiner

*Primary Examiner* — Trinh Dinh
(74) *Attorney, Agent, or Firm* — McGarry Bair PC

(57) ABSTRACT

A CB antenna arrangement for use in a raised roof of a truck cab enables the CB antenna to be hidden from view while maintaining good performance. An LC circuit is mounted in the space between the headliner and the raised dielectric roof and is connected to one of the metallic pillars of the truck cab. A CB antenna is connected to the LC circuit, and is mounted to and extends along the inside surface parallel to the driver's side or the passenger's side. The LC circuit is configured to block signals outside the CB frequency range, and the metallic pillar provides a ground plane for the CB antenna.

8 Claims, 6 Drawing Sheets

HIDDEN CB ANTENNA ARRANGEMENT

RELATED APPLICATIONS

This application claims the benefit of U.S. Application Ser. No. 61/584,908 filed Jan. 10, 2012.

BACKGROUND OF THE INVENTION

1. Field of the Invention

The invention relates to antenna arrangements for installation under dielectric covers, and more particularly to antennas for use in motor vehicle structures.

2. Description of the Related Art

It is common for motor vehicles such as cars, trucks, tractors, recreational vehicles and the like to use several antennas for such purposes as cellular telephones, CB, global positioning system (GPS), weatherband (WB), and the standard AM/FM radio. This proliferation of antennas is attended by special problems such as finding an appropriate mounting position for non-interfering operation as well as such inconveniences as high-speed antenna noise or "whistle." Attempts have been made in the prior art to avoid external antennas and incorporate them into windowpanes and roof panels and the like.

Non-conducting materials such as fiberglass are now commonly used particularly in the construction of truck cabs in order to save weight. It is known to use flat plate antennas between the headliner and the nonconductive roof panel of truck cabs. See, for example, U.S. Pat. No. 5,402,134, U.S. Pat. No. 6,906,672, and the known use of three receiving wires of different lengths laid horizontally parallel or flared from a single attachment point where an AM receiving wire is typically 105 inches long, an FM wire 30 inches, and a WB wire 16 inches. Each of these known solutions has limitations in various applications, especially in the CB frequency range. Newer cabs are more aerodynamic with sweeping rooflines that have a more vertical component than prior rooflines.

SUMMARY OF THE INVENTION

The present invention of an antenna arrangement for a hidden CB antenna between the headliner and the nonconductive roof panel of truck cabs takes advantage of the newer rooflines to provide improved performance over the prior art flat panel antenna arrangements. The novel antenna arrangement is useful in a truck cab having a first metallic pillar at a driver's side, a second metallic pillar at a passenger's side, a raised dielectric roof extending from the first and second metallic pillars and having an inside surface, a headliner, and a space between the headliner and the inside surface. One embodiment of the invention has an LC circuit mounted in the space between the headliner and the raised dielectric roof and connected to one of the first and second metallic pillars. Further, a CB antenna is connected to the LC circuit, and is mounted to and extends along the inside surface parallel to the driver's side or to passenger's side. The LC circuit is configured to block signals outside the CB frequency range. As well, the metallic pillar provides a ground plane for the CB antenna. With this structure, the CB antenna remains hidden from view.

DESCRIPTION OF THE PREFERRED EMBODIMENT

Figure 1:
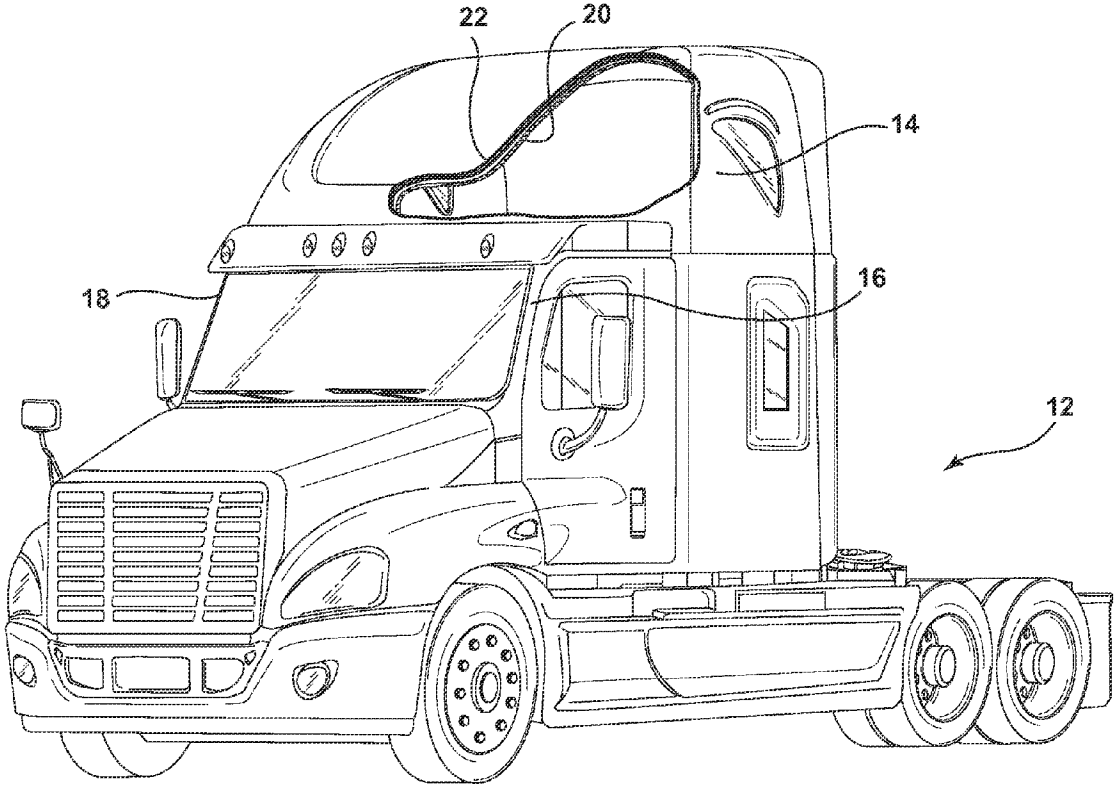
FIG. 1 is a view showing the type of truck cab for embodiments of the CB antenna arrangement of the invention.

A hidden CB antenna arrangement 10 according to the invention is illustrated in the environment of a truck cab 12 in FIG. 1. The truck cab 12 is the type having a raised roof 14, such as might be found in a roof fairing for a sleeper cab. The raised roof 14 is made of a dielectric material, but mounted adjacent to metal components of the truck cab 12 such as the driver and passenger side pillars 16, 18. A headliner 20 inside the truck cab 12 may or may not follow the contour of the raised roof 14, but it defines a space 22 between the headliner and the raised roof.

Figure 2:
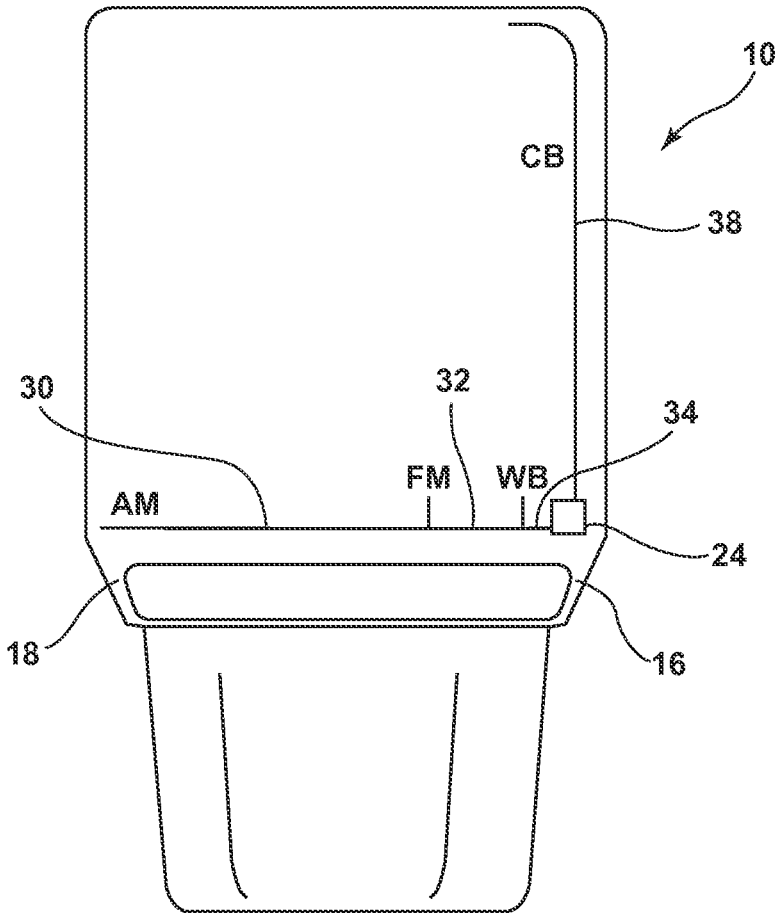
FIG. 2 is a plan view of the truck cab of FIG. 1 showing a first embodiment of the CB antenna arrangement of the invention.
Figure 3:
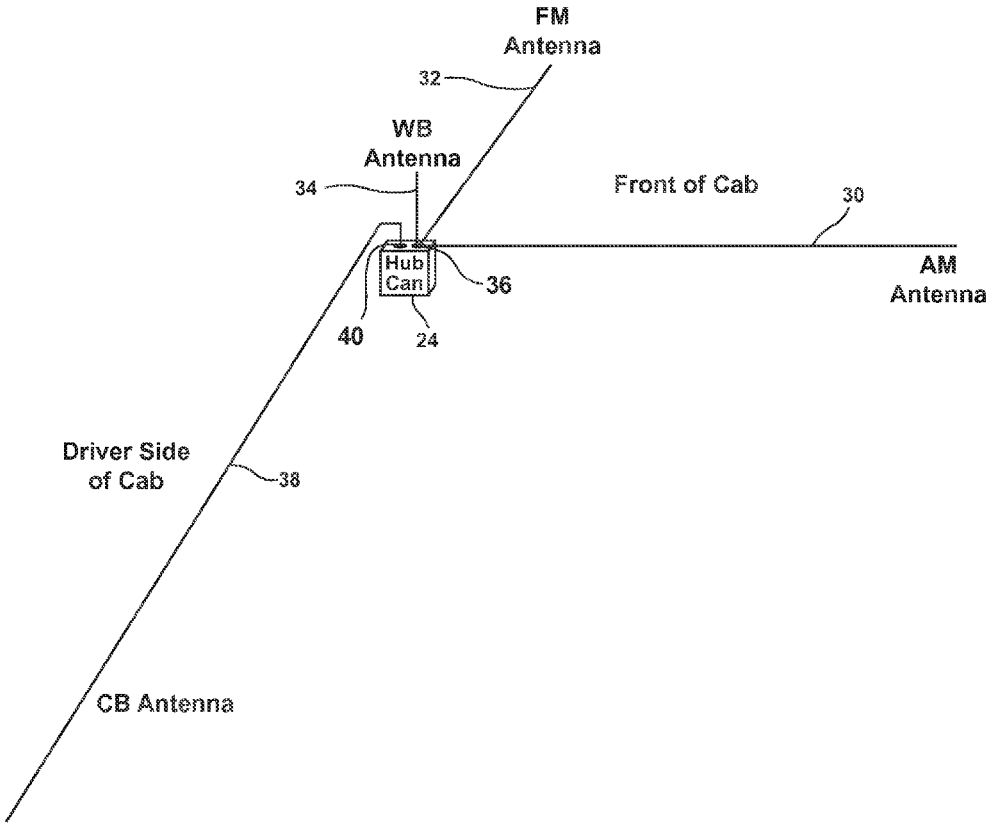
FIG. 3 is a schematic view showing the first embodiment of the CB antenna arrangement according to the invention.
Figure 4:
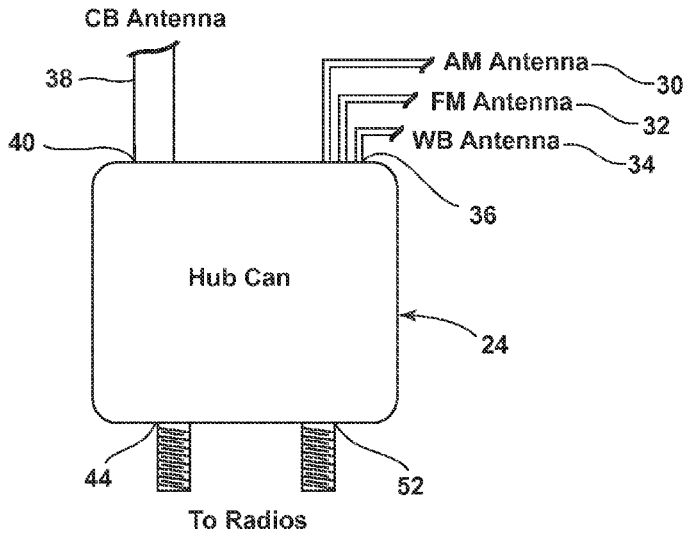
FIG. 4 is a plan view of the hub can in the first embodiment of the CB antenna arrangement according to the invention.

In one embodiment looking also at FIGS. 2-4, the hidden CB antenna arrangement 10 comprises a hub can 24 mounted between the headliner 20 and the raised roof 14 at the driver's side pillar 16. It can be seen that an AM antenna 30, an FM antenna 32, and a weather band (WB) antenna 34 extend from a first port 36 in the hub can 24. A CB antenna 38 extends from a second port 40 in the hub can 24. The AM antenna 30 preferably extends parallel to the front of the truck cab 12 and is secured to the inside surface of the raised roof 14. The FM antenna 32 and the WB antenna 34 can comprise separate radiators extending from the first port 36 parallel to the AM antenna, or, preferably, one or both FM and WB bands can be subdivided on the AM antenna 30 in a known manner. The length of each of the AM, FM, and WB antennas is selected to resonate in the respective frequencies (AM: 535 KHz-1.7 MHz; FM: 88 MHz-108 MHz; WB: 162 MHz). For example, good performance has been achieved where the AM antenna is as long as space will allow, the FM antenna 32 is about 19 inches long, and the WB antenna 34 is about 14 inches long.

The CB antenna 38 extends normal to the AM antenna and parallel to the driver's side of the truck cab, secured to the inside surface of the raised roof 14. Its length is selected to resonate in the citizens band frequency range (CB: 26.965 MHz-27.405 MHz) and preferably one quarter wavelength of the midpoint of the CB spectrum, or about 108". If the truck cab is not long enough for the full 108" extension, it can be curved around the back side of the roofline as shown in FIG. 2. Providing the full 108" length (approx.) provides better performance than prior art exterior CB antennas which had to be shortened to 48" or so (to meet road requirements of overpasses) and top loaded to obtain an electrical length equivalent to one quarter wavelength, but at a cost of gain. The present embodiment more than overcomes the fact that the antenna is buried next to other wires and metallic objects and is swept back at an angle, not perfectly vertical.

Figure 5:
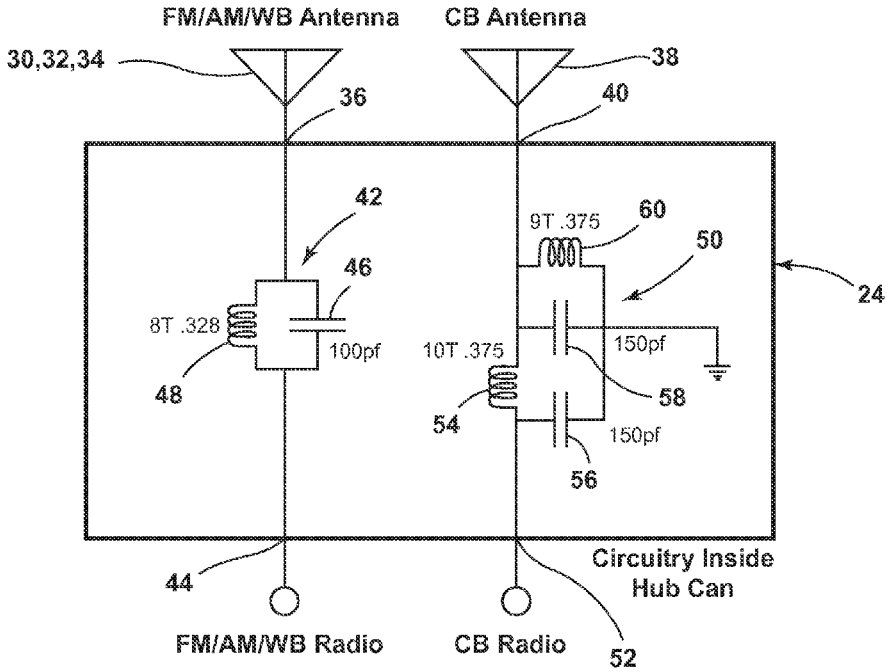
FIG. 5 is a schematic view of the circuits in the hub can of FIG. 4.

Looking now also at FIG. 5, at the hub can 24, the AM/FM/WB antennas 30, 32, 34 are connected via a resonant L-C circuit 42 to an AM/FM/WB radio port 44 that permits connection to an AM/FM/WB radio (not shown). The L-C circuit 42 preferably comprises 100 pico farad (pf) capacitor 46 wired in parallel with an eight-turn, 0.328" inductor coil 48. Ideally, the capacitor 46 will have a value such that it presents essentially a low impedance connection at the FM frequency range, and a substantial impedance in the CB frequency range. In other words, the L-C circuit 42 is preferably configured to block or filter out any signals that would interfere with the intended AM, FM, and WB frequencies.

The CB antenna 38 is connected via a second L-C circuit 50 to a CB port 52 that permits connection to a CB radio (not shown). The second L-C circuit 50 preferably comprises a ten-turn 0.375" inductor coil 54 in series between two parallel 150 pf capacitors 56, 58, one of which is also in parallel to a nine turn 0.375" inductor coil 60. The capacitors 56, 58 and inductor coil 60 are connected to ground, preferably the driver side pillar 16 which (with other connected metal components of the truck cab) provides an effective ground plane for the CB antenna 38. FIG. 3 shows a wire frame drawing that illustrates the ground plane concept for the CB antenna 38. Even with plastic panel body pieces, a truck cab typically has enough metal cage pieces to create an effective ground plane sufficient for the low frequencies of the CB range.

Figure 6:
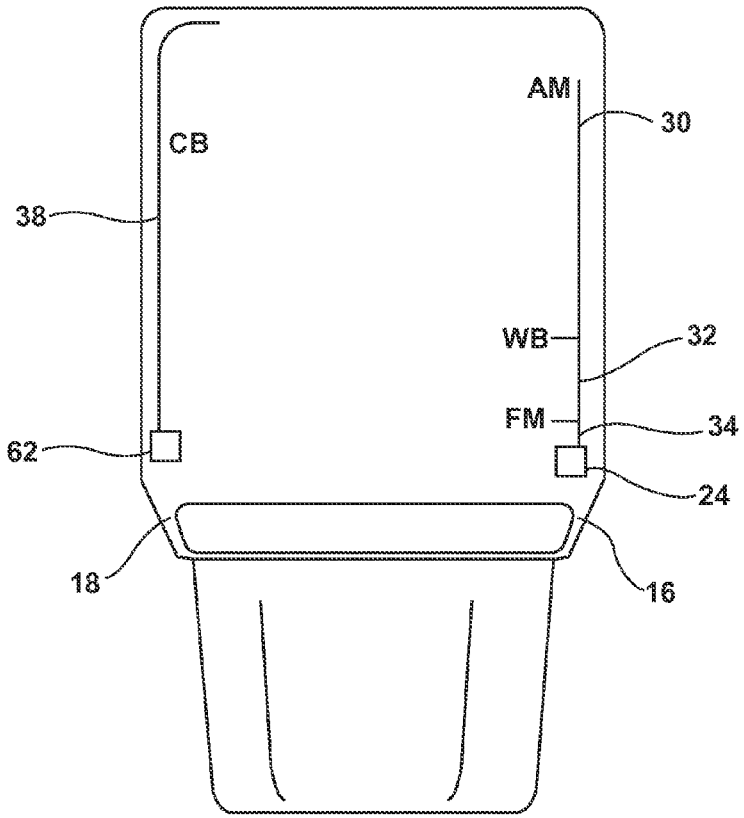
FIG. 6 is a plan view of the truck cab of FIG. 1 showing a second embodiment of the CB antenna arrangement of the invention.

In a second embodiment shown in FIG. 6, the CB antenna 38 is not connected to the hub can 24, but wired separately to a second hub can 62 on the passenger side apart from the first hub can 24 with the same L-C circuit 50 to block or filter out interference with the AM/FM/WB antennas. The L-C circuit 50 is preferably configured to block or filter out any signals that would interfere with the intended CB frequency. The hub can 62 provides a ground plane via the passenger side pillar 18. In this case, the AM/FM/WB antennas will typically extend parallel to the driver's side and not across the front of the cab.

Figure 7:
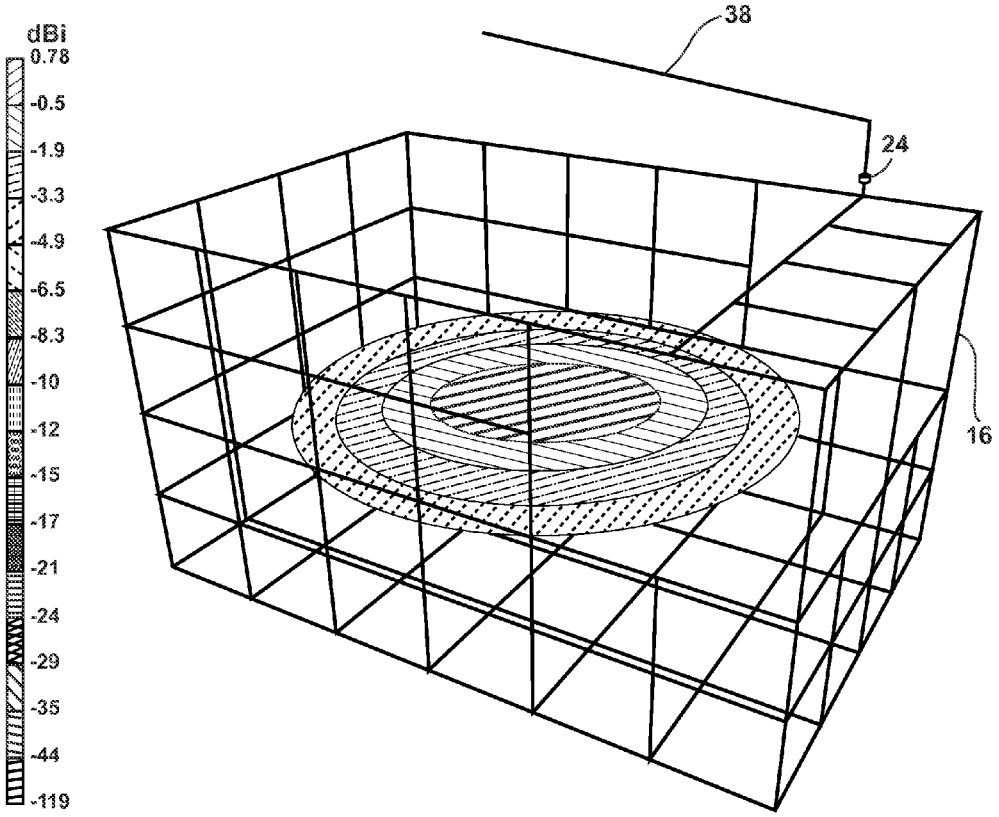
FIG. 7 is a schematic wire frame view of showing the azimuth of the radiation pattern of the first embodiment of the CB antenna arrangement of the invention.

FIG. 7 shows in 3D a typical azimuth pattern for the CB antenna 38 of the driver's sided embodiment.

While the invention has been specifically described in connection with certain specific embodiments thereof, it is to be understood that this is by way of illustration and not of limitation, and the scope of the appended claims should be construed as broadly as the prior art will permit.

The invention claimed is:

1. In a truck cab having a first metallic pillar at a driver's side, a second metallic pillar at a passenger's side, a raised dielectric roof extending from the first and second metallic pillars and having an inside surface, a headliner, and a space between the headliner and the inside surface, the improvement comprising:

an inductor-capacitor (LC) circuit mounted in the space between the headliner and the inside surface and connected to one of the first and second metallic pillars, and a citizens band (CB) antenna connected to the LC circuit, and mounted to and extending along the inside surface parallel to one of the driver's side and passenger's side, wherein the LC circuit is configured to block signals outside the CB frequency range, and the one of the first and second metallic pillars provides a ground plane for the CB antenna, while the CB antenna remains hidden from view.

2. The improvement of claim 1 wherein the LC circuit is mounted within a hub can.

3. The improvement of claim 2 further comprising a second LC circuit in the hub can connected to the one of the first and second metallic pillars, and an amplitude modulation (AM) antenna connected to the second LC circuit, and mounted to and extending along the inside surface normal to the CB antenna.

4. The improvement of claim 3 wherein the second LC circuit is configured to block signals outside the AM frequency range.

5. The improvement of claim 3 wherein the AM antenna is subdivided to resonate also in frequency modulation (FM) and weatherband (WB) frequency bands.

6. The improvement of claim 1 further comprising a second LC circuit mounted in the space between the headliner and the raised dielectric roof and connected to the other of the first and second metallic pillars, and an AM antenna connected to the second LC circuit, and mounted to and extending along the inside surface parallel to the CB antenna.

7. The improvement of claim 6 wherein the second LC circuit is configured to block signals outside the AM frequency range.

8. The improvement of claim 6 wherein the AM antenna is subdivided to resonate also in FM and WB frequency bands.

* * * * *